United States Patent [19]

Miller

[11] 4,369,590

[45] Jan. 25, 1983

[54] REAR MOUNTED SCRAPER FOR VEHICLES

[76] Inventor: Michael E. Miller, 204 W. Church St., Savoy, Ill. 61874

[21] Appl. No.: 212,360

[22] Filed: Dec. 3, 1980

[51] Int. Cl.[3] ..... E01H 5/06

[52] U.S. Cl. ..... 37/231; 37/235; 37/241; 37/271; 37/283; 172/247; 172/490; 172/684.5

[58] Field of Search ..... 37/42 R, 50, 41, 29, 37/35, DIG. 3, 117.5; 172/248, 272, 445.2, 445.1, 477, 478, 490, 684.5, 829, 247

[56] References Cited

U.S. PATENT DOCUMENTS

| | | | |
|---|---|---|---|
| 1,574,732 | 2/1926 | Hemje | 172/490 X |
| 2,517,426 | 8/1950 | Hall | 172/272 X |
| 2,740,214 | 4/1956 | Collins | 172/445.2 |
| 2,787,847 | 4/1957 | Acps | 172/445.2 |
| 2,787,876 | 4/1957 | Cole | 172/477 X |
| 2,815,591 | 12/1957 | Mattingly | 172/445.2 |
| 3,195,249 | 7/1965 | Collins | 172/445.2 X |
| 3,515,221 | 6/1970 | Fowler | 172/445.2 |
| 3,800,447 | 4/1974 | Harvey | 37/41 |
| 3,828,449 | 8/1974 | Miceli | 37/41 |
| 4,215,496 | 8/1980 | Wehr | 172/829 X |

FOREIGN PATENT DOCUMENTS

| | | | |
|---|---|---|---|
| 1365467 | 5/1964 | France | 172/478 |

*Primary Examiner*—Edgar S. Burr
*Assistant Examiner*—Moshe I. Cohen
*Attorney, Agent, or Firm*—Kalish & Gilster

[57] ABSTRACT

Scraper apparatus for being carried at the rear of a vehicle such as a light truck or the like includes an attachment frame adapted for being carried by the vehicle beneath its chassis thereof at the rear of the vehicle. A blade-carrying frame for carrying the blade at the rear of the vehicle is pivotally and detachably securable to the attachment frame at the rear of the vehicle by use of a securement frame or unit providing telescoping interengagement with the attachment frame, and pivotal interengagement with the blade-carrying frame to define a transverse pivot axis to permit pivoting of the blade-carrying frame upon the axis relative to the vehicle. A winch selectively raises or lowers the pivot-remote end of the blade-carrying frame under remote operator control. The blade is pivotally secured to the blade-carrying frame by a sleeve in which is rotatably journalled a shaft secured to the blade. A locking mechanism locks the shaft relative to the sleeve to establish a pre-selected angular relationship between the blade and the longitudinal axis of the vehicle. When pivoted to raise the pivot-remote end thereof, the blade-carrying frame maintains the blade close to the rear of the vehicle out of contact with the surface upon which the vehicle stands. When lowered, the blade-carrying frame permits the blade to contact the surface with the blade-carrying frame extending rearwardly from the vehicle. The apparatus also permits connection of a standard ball hitch and permits the winch to be used conventionally.

4 Claims, 11 Drawing Figures

REAR MOUNTED SCRAPER FOR VEHICLES

BACKGROUND AND SUMMARY OF THE INVENTION

This invention relates to vehicle mounted scrapers and, more particularly, to a novel scraper apparatus for being mounted at the rear of a light truck or similar vehicle.

Conventionally, light trucks have had scraper blades mounted at the front of the truck for clearing snow, light scraping, and the like. Such a front-mounted scraper arrangement interferes with the normal usage of the truck since the blade extends an objectionable distance in front of the truck when the scraper is not being used, as well as presents an obstacle to vision.

For these and other reasons, it is desirable to be able to attach the scraper at the rear of the vehicle. But practical apparatus has not heretofore existed by which a scraper blade can be effectively and easily mounted at the rear of the vehicle.

Accordingly, an object of the invention is the provision of a scraper apparatus for being carried at the rear of a vehicle such as a light truck or the like.

Another object of the invention is the provision of such scraper apparatus which can be conveniently secured to and removed from the vehicle in a very rapid and simple manner.

A related object of the invention is the provision of such a scraper which can be secured to trucks of different types and heights, i.e., having different ground clearances.

Yet another object of the invention is the provision of such scraper apparatus which allows for a scraper blade to be moved between a lowered position, for scraping, and a raised position, for transport, and when in said raised position maintaining the scraper blade close to the rear of the vehicle without extending objectionally too far rearwardly and, further, when so carried, providing unobstructed rear visibility from the vehicle as well as permitting the vehicle lights, license plate, etc., to be plainly visible from the rear.

A further object of the invention is the provision of such scraper apparatus which allows the scraper to be oriented with a desired angular relationship to the longitudinal axis of the vehicle, as well as permitting the blade to face either forwardly for being pulled by forward movement of the vehicle, or rearwardly, for being pushed by reverse movement of the vehicle.

Another object of the invention is the provision of such a scraper apparatus permitting the blade to be selectively adjusted in position to provide desired blade orientation, tilt, contact angle, and so forth.

Among still other objects of the invention may be noted the provision of such scraper apparatus which is configured for allowing attachment of a conventional ball hitch; which utilizes a remotely-controlled mechanism for raising and lowering of the blade; which is relatively easily manufactured and assembled; and which is extremely rugged, durable, and long-lasting in operation.

Other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
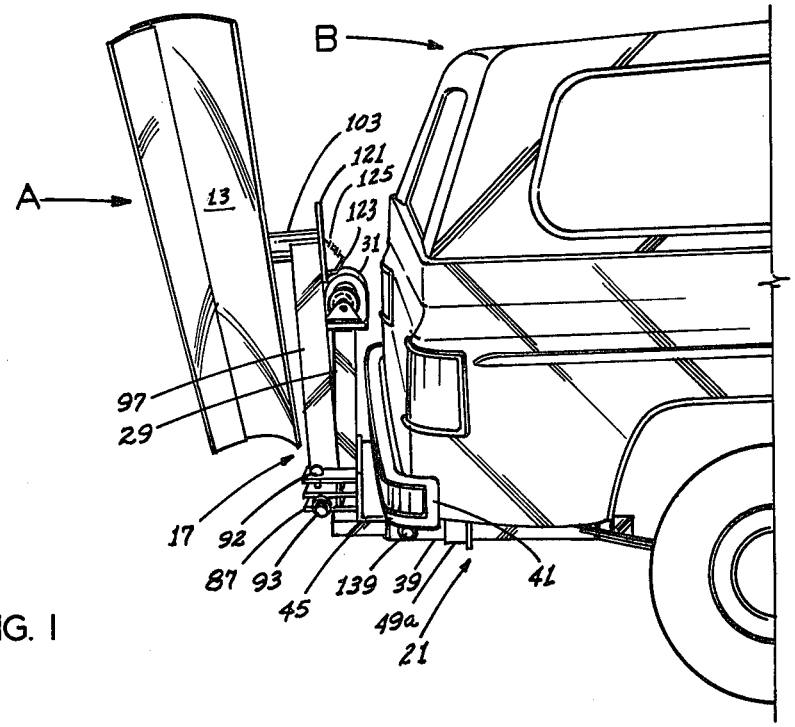
FIG. 1 is a perspective view of a vehicle equipped with a rear-mounted scraper constructed in accordance with and embodying the present invention.

Referring now by reference characters to the drawings, indicated by A is a scraper apparatus of the invention shown carried at the rear of a light truck B, the latter being representative of various vehicles to which apparatus A can be so secured. Apparatus A comprises a scraper blade 13 carried pivotally at one end of a blade-carrying frame designated generally 17. Frame 17 is pivotally secured (see also FIG. 2) at opposite ends 19, 19' to an attachment frame, designated generally 21, which is in turn secured to vehicle B in a manner explained hereinbelow. The attachment of frame 17 to frame 21 provides a transverse pivot axis, extending through a frame member permitting pivoting of frame 17 between a lowered position, as demonstrated in FIG. 6, and a raised position shown in FIGS. 1 and 2.

Figure 5:
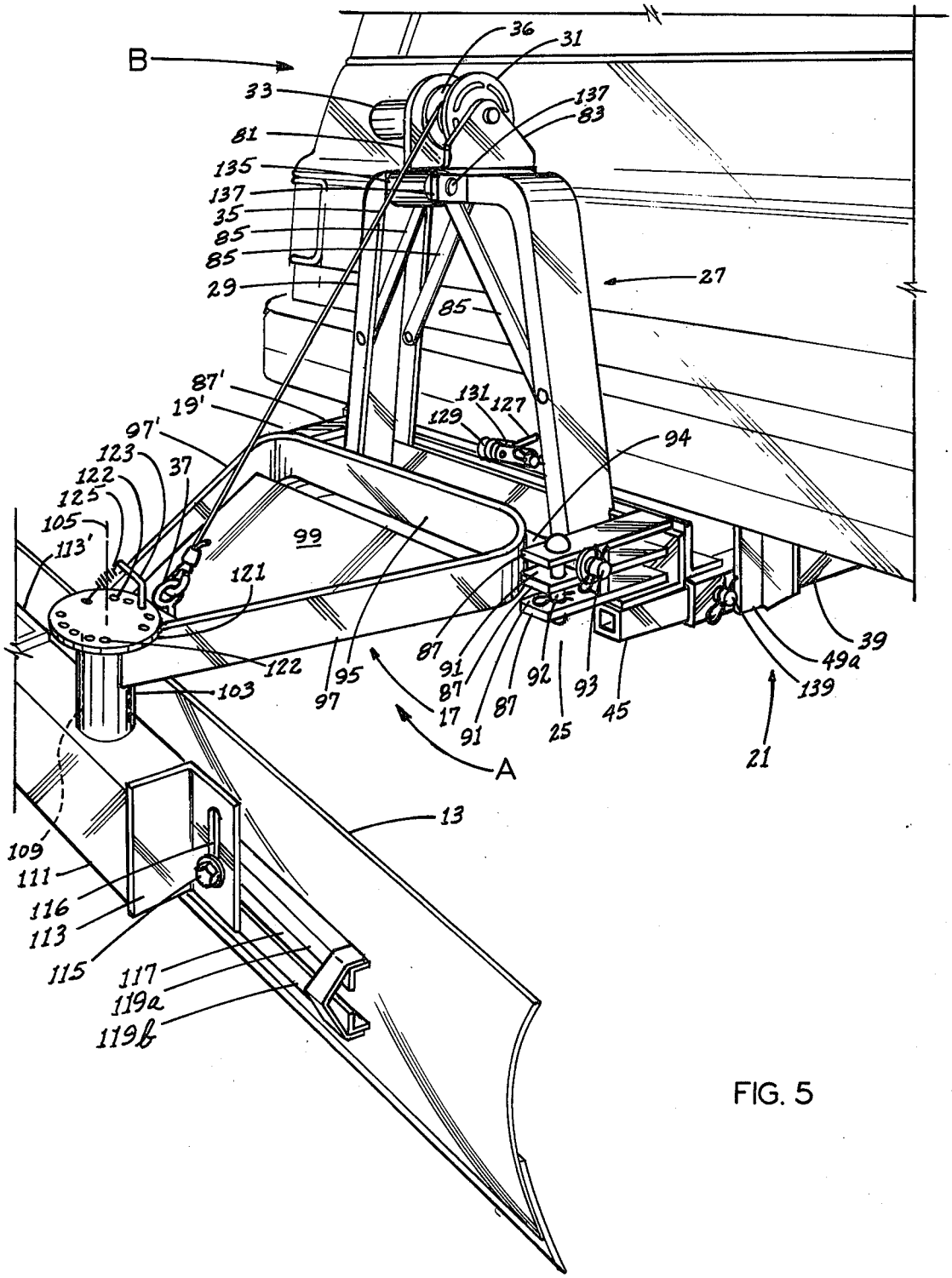
FIG. 5 is an enlarged perspective view of portions of the scraper apparatus with its scraper blade positioned for ground contact and illustrating details and interrelationship of components of the new apparatus.

Referring now also to FIG. 5, the opposite sides 19, 19' of frame 17 are secured to attachment frame 21 by securement fittings 25, 25' at opposite sides of frame 17. These fittings constitute portions of a securement unit designated in its entirety generally at 27, which unit includes a frame 29 having at its upper end an electrically operated winch 31, adapted to be driven by a motor 33 for selectively raising and lowering of the pivot-remote end of frame 17 with respect to the pivot axis. For this purpose, hook 34 of a cable 35 wound around a drum 36 of winch 31 is attached to frame 17 by an eye 37 secured to the pivot-remote end 15 of frame 17.

Figure 2:
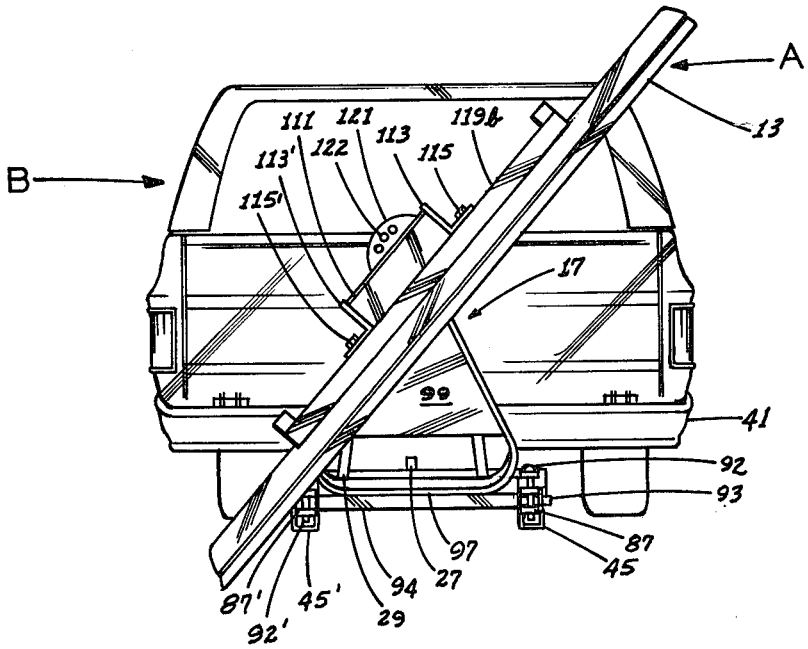
FIG. 2 is a perspective view of the rear of the vehicle and scraper mounted thereon, with the scraper in a raised position as in FIG. 1.
Figure 3:
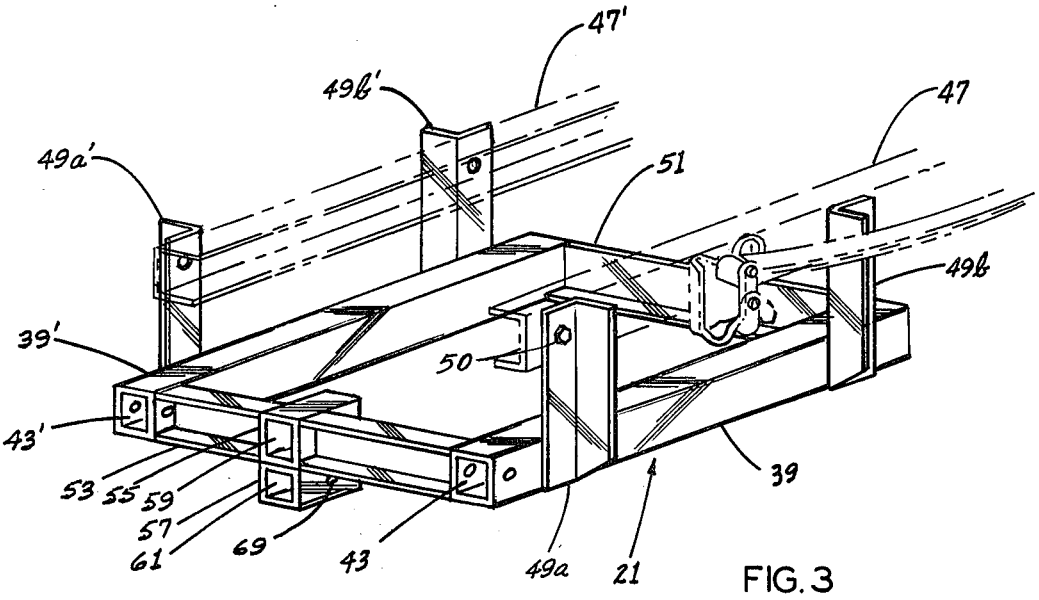
FIG. 3 is a perspective view of a mounting or attachment frame adapted for being relatively permanently secured to the vehicle to permit selective attachment of the scraper to the vehicle.
Figure 4:
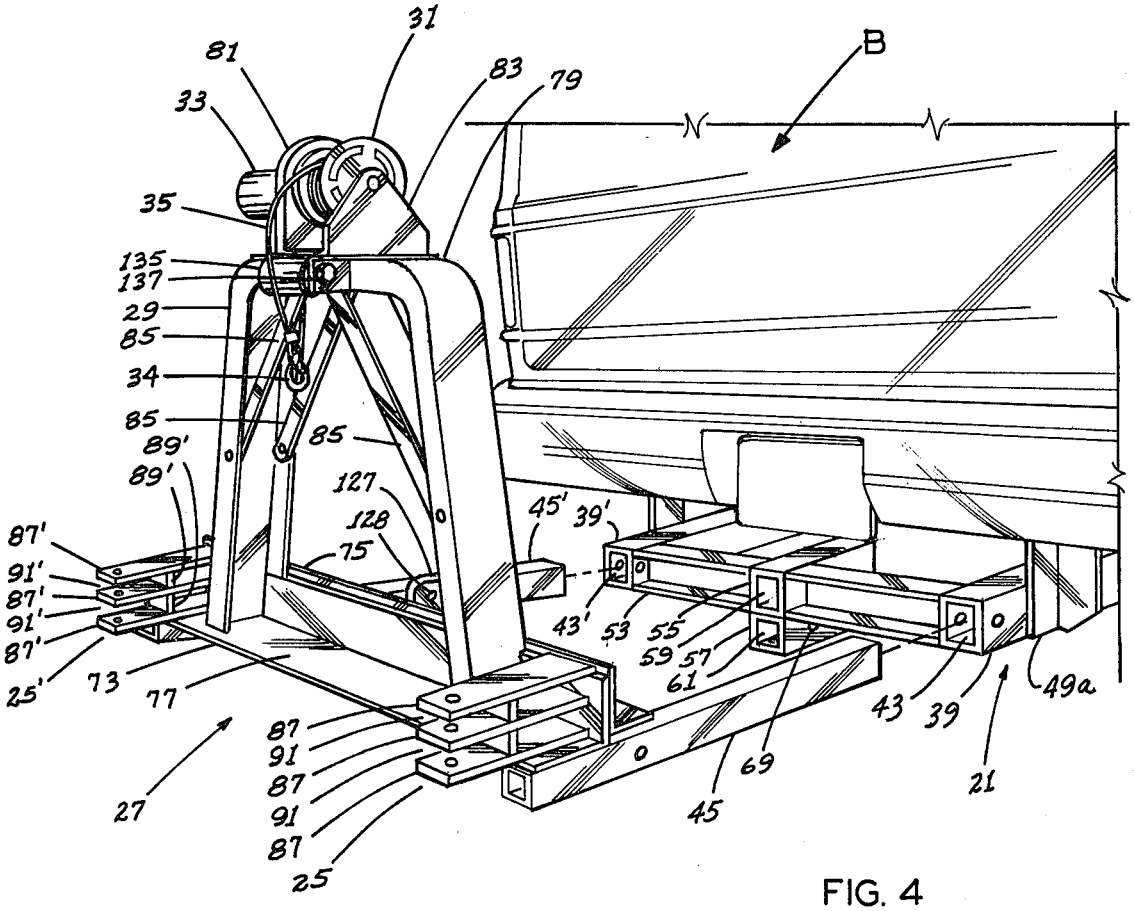
FIG. 4 is a perspective view in the nature of an exploded or assembly view, for illustrating the positioning of various components of scraper apparatus of the invention for securement to the vehicle by interengagement with said attachment frame.

The attachment of apparatus A to vehicle B by means of attachment frame 21 is more specifically revealed by FIG. 3, wherein frame 21 is seen to comprise horizontal frame members 39, 39', each of rectangular cross section for defining their respective ends under the bumper 41 (FIG. 2) of vehicle B, a pair of rectangular openings or sockets 43, 43' for telescopingly, i.e., slidably, receiving corresponding horizontal frame members 45, 45' of securement unit 27, as demonstrated in FIG. 4. Thus, frame members 45, 45' define telescoping members for being telescopingly received in the sockets 43, 43' defined by members 39, 39'. Frame members 39, 39' are each secured to the chassis frame members 47, 47' of the vehicle by pairs of L-section brackets 49*a*, 49*b* and 49*a*', 49*b*' which are bolted, as at 50, to chassis frame members 47, 47' and to the corresponding horizontal members 39, 39' at their upper and lower ends, respectively. Transversely bridging the forward end of frame 21 between frame members 39, 39' is an L-section frame member 51.

Figure 11:
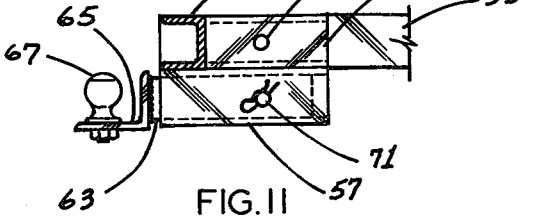
FIG. 11 is a side elevation view of an adapter unit providing a ball-type hitch coupling by interengagement with the adapter frame of FIG. 3.

At the rearward end a frame member 53 transversely extends between the rearward ends of frame members 39, 39', being of U-section and carrying at its mid-point a pair of hitch receiving units 55, 57, each consisting of a longitudinally extending length of rectangular tubing to provide corresponding upper and lower rectangular openings 59, 61, each being suited for slidably, telescopingly receiving a correspondingly reduced dimension rectangular member, such as shown at reference numeral 63 (see FIG. 11) having at its outer extremity a bracket member 65 carrying a trailer hitching ball 67 of conventional type. Each of said units 55, 57 preferably has a hole transversely drilled through it, as shown at 69, for receiving a pin, as at 71, for locking member 63 therein. These couplings 55, 57 provide for two different possible heights of securement for a conventional trailer to ball 67. Thus, securement unit 27 provides an extremely durable, heavy-duty character trailer hitch with attachment frame 21 providing the requisite strength and structure for pulling a trailer of heavy type, while serving for pivotal attachment of the rear mounted scraper blade.

Referring to FIG. 4, unit 27 comprises a pair of back-to-back L-section transverse frame members 73, 75 which interconnect the rearmost portions of frame members 45, 45', and with member 73 having a horizontally extending flange providing a surface 77 upon which frame 29 is seated. The latter is of channel section and of inverted U-shaped configuration to provide a structure of essentially yoke-like character having an upper surface 79 upon which winch 31 is secured by brackets 81, 83. Within frame 29, internal cross bracing is provided, as shown at 85.

Figure 8:
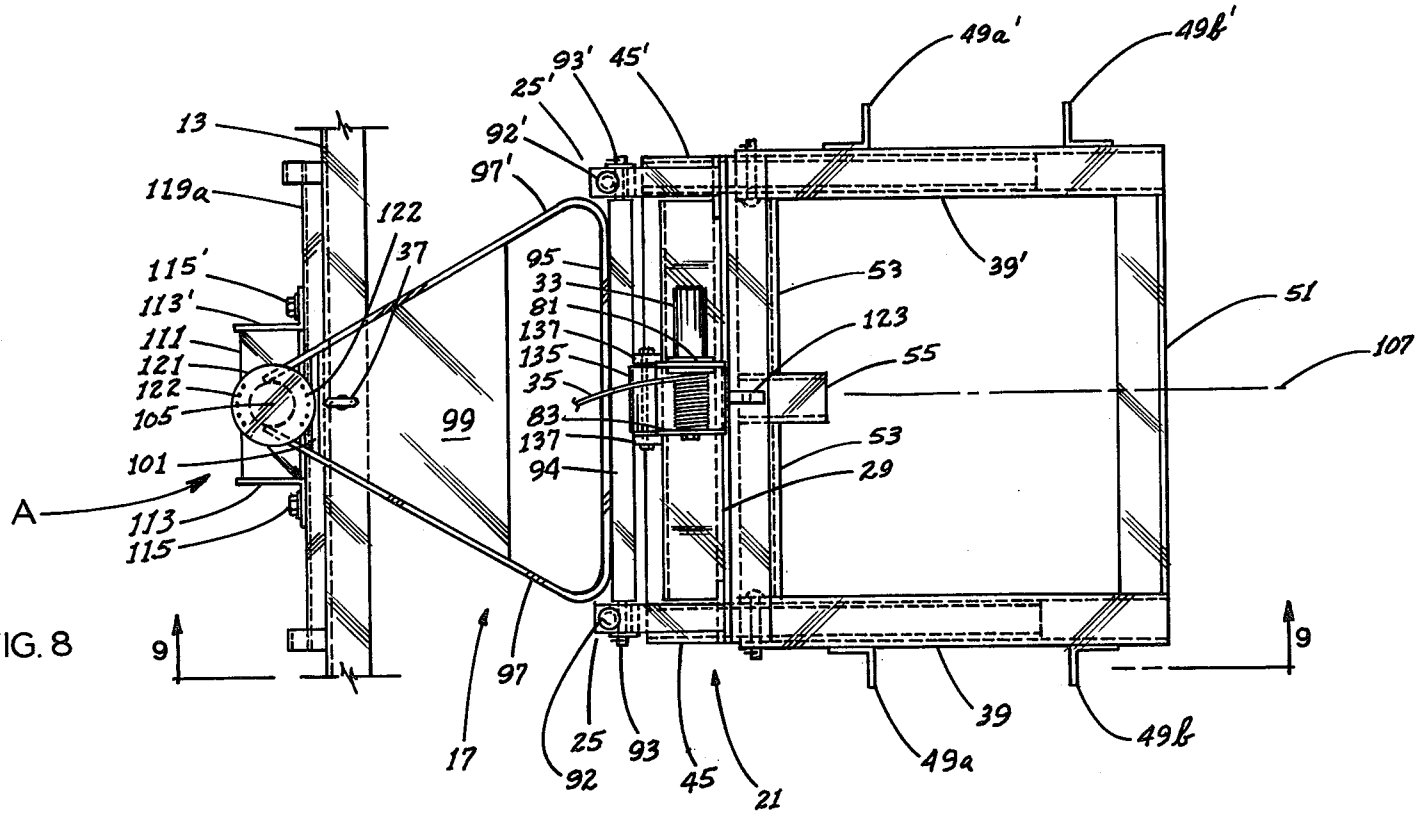
FIG. 8 is a top plan view of the new scraper apparatus of the invention, including the attachment frame of FIG. 3.

Located at the outer extremities of transverse member 73 are the securement fittings 25,25'. These comprise a plurality of vertically spaced lengths of heavy stock, as at 87, 87', maintained in spaced relationship by respective spacers as at 89' to provide between the elongated members 87, 87' a plurality of forks or recesses 91, 91', at opposite sides of unit 27 for receiving respective pivot pins 93, 93' (see also FIG. 8) carried at the opposite ends of a transverse frame member 94 of frame 17. Pivot pins 93, 93' are held in place by securement pins 92, 92' which extend through holes in the ends of members 87, 87'. The vertically spaced apart openings 91, 91' provide a plurality of different possible locations for pins 93, 93' so that the pivot axis of frame 17 is locatable at different possible heights as may be desired for achieving a desired particular blade angle for disposition of frame 17 relative to vehicle B, or as may be necessary for use with various different kinds of vehicles, which may have different ground clearances.

Referring now to FIG. 5, the features of frame 17 are more readily apparent. Frame 17 is formed from a single length of heavy sheet stock to provide an essentially triangular form including a base portion 95 and side members 97, 97', from which extend side member securement pins 93, 93', which actually are carried by transverse frame member 94. Member 94 is a rectangular length of heavy stock to which member 95 is preferably welded. For stiffening, there is provided between side members 97, 97' an essentially triangular sheet 99 of heavy steel sheet material for thus strengthening frame 17 for heavy duty use. Eye 37 is secured to the pivot-remote end of sheet 99, which end is truncated as shown at 101 (FIG. 8) to provide for the mounting of a sleeve 103, as shown most clearly in FIG. 5, by means of which blade 13 is pivotally mounted upon blade-carrying frame 17 in pivotal relationship. This pivotal mounting defines a vertical pivot axis, as represented at 105 (FIG. 8), about which blade 13 is permitted to be selectively angularly oriented and so that a preselected angle may be established between blade 13 and the longitudinal axis, as at 107 (FIG. 8), of the vehicle.

Rotatably journalled within sleeve 103 is a shaft 109 which is rotatable within said sleeve for defining said pivot axis 105. Said shaft (FIG. 5) is attached to a box-like frame or support 111 having flanges at its opposite sides, as indicated at 113, 113'. Blade 13 is attached to said sleeve by means of a pair of large bolts, as at 115, 115', which extend through vertical slots 116, 116' in flanges 113, 113' and have suitable nuts or threaded members at their opposite ends which are slidably received in a channel 117 formed by oppositely oriented L-section lengths of material 119*a*, 119*b*. Accordingly, bolts 115 may be loosened for allowing blade 13 to be shifted several inches either vertically or horizontally and then tightened for desired positioning to the blade 13 with respect to securement structure 111. This allows also adjustment of the tilt of the blade.

At the top of shaft 109, there is provided a disc 121 having a plurality of holes 122 at intervals around its periphery. For locking of shaft 109 relative to sleeve 103, inserted within one of these holes and extending into a corresponding hole (not shown) of frame 17 is an L-shaped locking pin 123. Locking pin 123 is maintained reliably in its locking position, as shown in FIG. 5, by a tension spring 125 having one end affixed to disc 121. Accordingly, said pin 123 may be manually removed to permit reorientation of blade 13 with respect to the longitudinal axis of vehicle B and then replaced within a different one of the holes 122 to establish a preselected angle of the blade with respect to the vehicle.

When pin 123 is removed from its locking position, shaft 109 is free to rotate without angular limitation within sleeve 103, and so may be freely pivoted on axis 105° through 360° of movement. This permits the blade to be oriented not only as depicted in FIG. 6, wherein the blade is facing forwardly for being pulled by vehicle B, but also rearwardly, as in FIG. 7, for being pushed by vehicle B when the same is operated in reverse.

Accordingly, it will be appreciated that the new scraper apparatus conduces to extreme flexibility in operation, permitting the blade to be oriented as desired for a great many different types of jobs and applications. Thus, for snow removal, the blade may be oriented as in FIG. 6 for clearing a parking lot, driveway, walk, or the like, with the blade forming an angle with the longitudinal axis of the vehicle suitable for being pulled normally for scraping operation. Yet, when reoriented as in FIG. 7, blade 13 can be effectively pushed by vehicle B, thereby allowing it to be utilized for clearing snow, etc., in close proximity to a building, for example.

Figure 9:
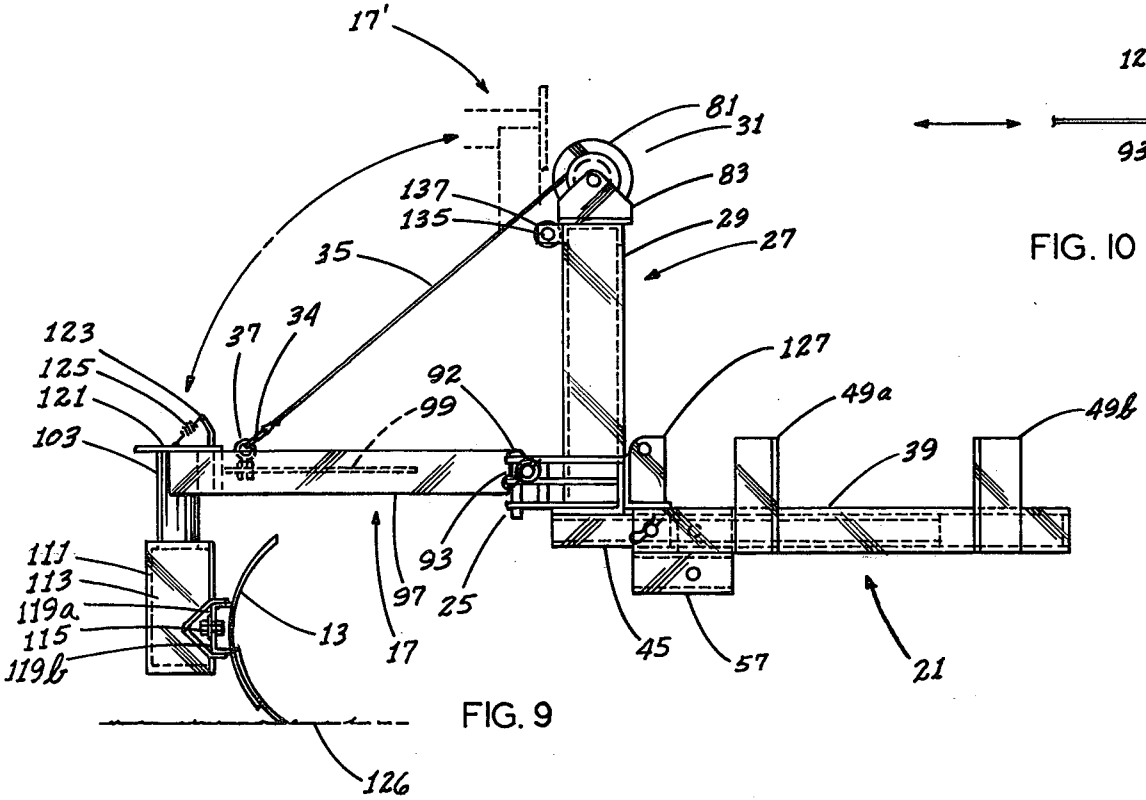
FIG. 9 is a side elevation view of the scraper apparatus, including said attachment frame, as viewed generally along line 9—9 of FIG. 8.

FIG. 9 demonstrates the movement of frame 17 upon its pivot axis defined by pins 93, 93' by tightening of cable 35 upon winch drum 36 to raise blade 13 from its position in contact with the ground surface 126 whereby the frame 17 moves from its position extending rearwardly from the vehicle to an essentially vertical position shown by dashed lines and designated at 17'.

Figure 6:
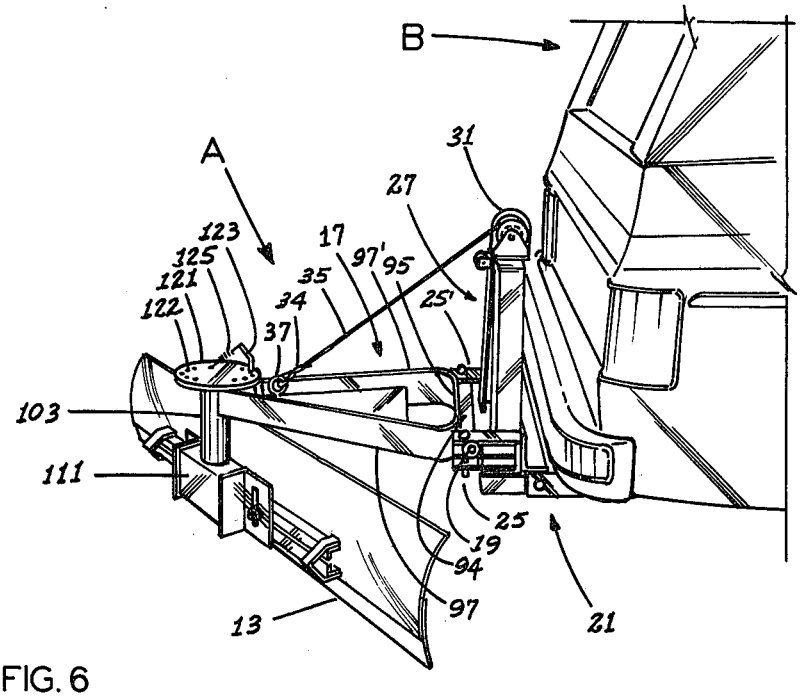
FIG. 6 is a perspective view similar to FIG. 1, but with the scraper apparatus configured for ground contact with the blade in an angular orientation suitable for being pulled by forward movement of the vehicle.
Figure 7:
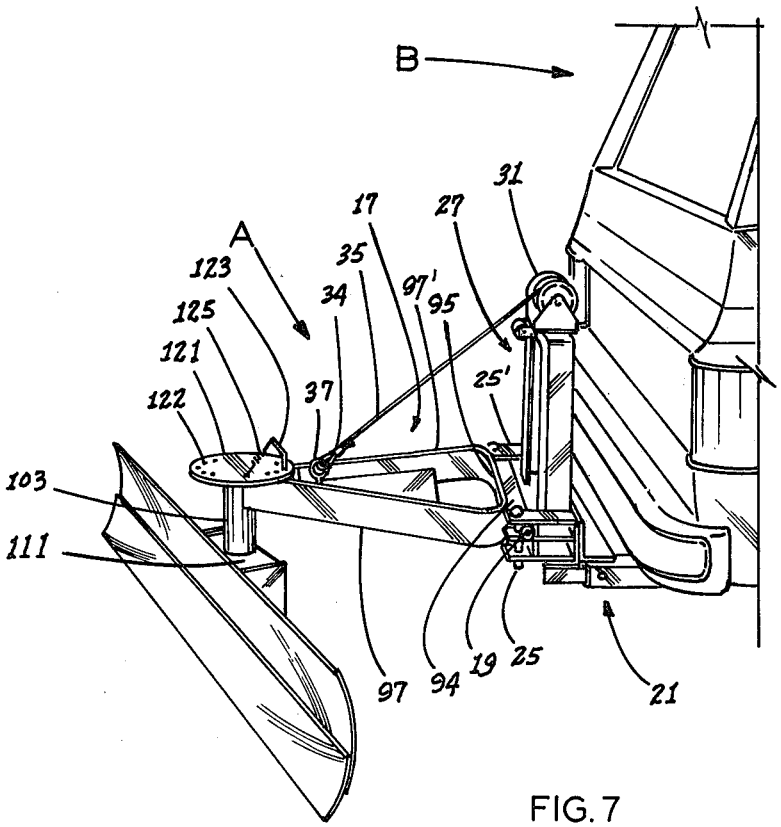
FIG. 7 is a perspective view similar to FIG. 6, but with the blade rotated upon a vertical pivot axis by 180° with respect to FIG. 6 for illustrating blade orientation suitable for the blade being pushed rearwardly by rearward movement of the vehicle.

The flexibility and advantages of the new scraper in use are further demonstrated by comparing the disposition of the apparatus with blade 13 in ground contact as demonstrated in FIG. 6 with the retracted position shown in FIGS. 1 and 2. As will be understood, motor 33 of winch 31 can be remotely operated by the operator of vehicle B causing cable 35 to be further wound on drum 36, thus raising the pivot-remote end of frame 17 to position the blade close to the rear of vehicle B as demonstrated most clearly in FIG. 1. The blade may be further pivoted upon axis 105 to orient the blade to the diagonal configuration clearly demonstrated in FIG. 2, whereby the blade neither greatly interferes with rearward vision of the driver nor blocks visibility of the taillights, license plate, and so forth.

Figure 10:
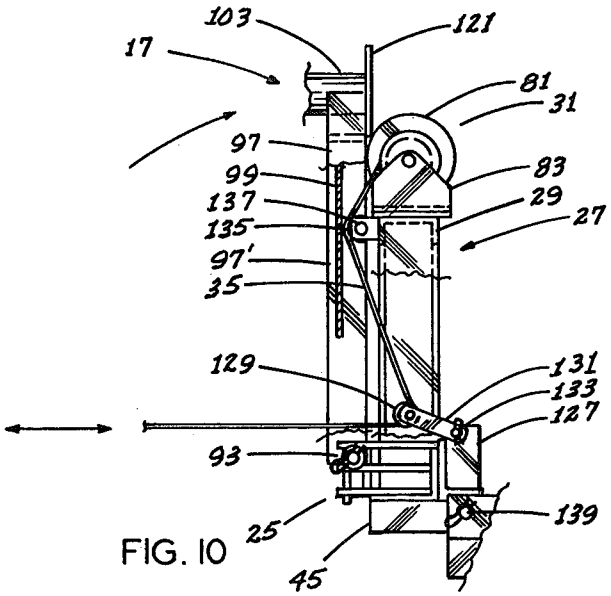
FIG. 10 is an enlarged side elevation view of portions of the new apparatus, with parts of a blade-carrying lift mechanism thereof broken away for illustrating component portions thereof.

The apparatus of the invention also makes possible the use of winch 31 in its conventional mode. For this purpose, unit 27 is preferably provided with an upright bracket member 127 having a hole 128 permitting the installation of a pulley 129 by a suitable pair of links, as at 131, which are secured to bracket 127 by pin 133, all as demonstrated in FIG. 10. Further, the upper end of frame 29 is provided with a roller 135 at its upper end secured on opposite ends as by brackets 137 over which cable 35 may pass and thence be threaded through links 131 and around pulley 129.

This arrangement allows tensile force to be applied by means of winch 31 in a direct line of connection with pulley 129 whereby the forces in the cable are applied most advantageously and directly to the truck B at a location where they will be utilized with the greatest advantage, such as in winching truck B from a position where it is struck, etc. Such winching capability may also be utilized even while the apparatus A, including frame 17 and blade 13, remains secured to the vehicle. For this purpose, frame 17 is merely maintained in the vertical position shown, as by suitably securing it, and then freeing the end of cable of being threaded over roller 135 and thence over pulley 129.

Alternatively, frame 17 may be quickly removed by detachment from securement unit 27, such requiring no more than the removal of pins 92, 92'. Accordingly, winch 31 may be retained in place for convenient use upon vehicle B with frame 17 and its blade 13 detached for storage purposes, thus retaining the various advantages of a winch yet permitting it to be removed when desired by disengagement of securement unit 27 from attachment frame 21, to which it is otherwise held fixed by pins such as that shown at 139 (FIG. 5).

Attachment frame is thus seen to be of a character for being relatively permanently fixed to vehicle B. Yet, it is a relatively simple matter to remove frame 21 from the vehicle by removing bolts 50 which hold members 49*a*, 49*a*', and 49*b*, 49*b*'. Subsequently, frame 21 is easily attached to a different vehicle.

In view of the foregoing, it will be seen that the various objects of the invention and other advantageous results are obtained.

Although the foregoing includes a description of the best mode contemplated for carrying out the invention, various changes and modifications are contemplated.

It should be understood that changes and modifications in the formation, construction, arrangement, and combination of the various parts of the scraper apparatus of this invention may be made and substituted for those herein shown and described without departing from the nature and principle of this invention. The description, accordingly, shall be interpreted as illustrative rather than limiting.

What is claimed is:

1. In combination, self-contained scraper apparatus for quick attachment to, and detachment from, the rear of a light truck vehicle or the like, and attachment means suspended from the frame of said vehicle, the entirety of said attachment means being positioned at a level substantially at or below the bumper level of said vehicle characterized by said scraper apparatus comprising a securement frame having a pair of laterally spaced forwardly projecting telescoping frame members, said attachment means including an attachment frame mounted to the chassis of said vehicle at the rear thereof and having a pair of socket-defining recesses at opposite sides of said vehicle for telescopingly receiving corresponding ones of said telescoping frame members, means for securing said telescoping frame members in the respective socket-defining members, said scraper apparatus being thereby attachable to and carryable by said vehicle solely by telescoping frame members being received in said socket-defining members, a scraper blade, a blade-carrying frame, means for pivotally connecting said scraper blade to said blade-carrying frame, means providing pivotal interengagement of said blade-carrying frame to said securement frame to permit rotation of said blade-carrying frame about a transverse pivot axis, an electric winch carried by said securement frame, a winch cable extending from said electric winch to a transverse pivot axis-remote location on said blade-carrying frame, said winch being energizable in response to voltage supplied by said vehicle, whereby said winch effects raising of said blade-carrying frame by rotation about said transverse pivot axis under operator remote control, said means for pivotally connecting said blade to said blade-carrying frame including a sleeve carried by said blade-carrying frame at a location remote from said transverse pivot axis, a shaft secured to said blade and rotatable in said sleeve, and means for locking said shaft relative to said sleeve for permitting a preselected angular relationship between said blade and the longitudinal axis of said vehicle, said blade being pivotable by rotation of said shaft between forward facing and rearward facing orientations, said blade-carrying frame when raised by said winch pivoting upon said transverse pivot axis to raise said blade out of contact with the surface upon which said vehicle stands, and to a position proximate the rear of said vehicle, and when lowered by said winch permitting said blade to contact said surface with said blade-carrying frame extending rearwardly from said securement frame and from said vehicle with said blade having either forwardly or rearwardly facing orientation, whereby said scraper apparatus may be either quickly attached to or detached from said attachment by telescoping movement of said telescoping frame means members relative to said socket-defining members.

2. The combination according to claim 1 and further characterized by said attachment frame being mounted to the chassis of said vehicle beneath said vehicle, said socket-defining members each having tubular frame members extending lengthwise of said vehicle parallel to the longitudinal axis thereof, said telescoping frame members comprising elongated frame members of cross section corresponding to said socket-defining members for being slidingly received within said socket-defining members by longitudinal movement of said vehicle relative to said scraper apparatus.

3. The combination according to claim 1 and further characterized by said securement frame comprising a generally vertical frame extending upwardly from a point of interengagement with said attachment frame whereby said vertical frame is carried in close proximity to the rear of said vehicle, said vertical frame defining a support for said winch located above said transverse pivot axis.

4. The combination according to claim 3 and further characterized by said blade-carrying frame including at each of opposite sides a respective transverse pivot pin, said pivot pins together defining said transverse pivot axis, said vertical frame presenting a plurality of corresponding slots for receiving said pins, and means for selectively securing said pins in said slots, said plurality of different slots at different sides providing different securement locations for each said pivot pin for corresponding location of said transverse pivot axis at different possible heights, whereby the disposition of said blade-carrying frame relative to said vehicle may be varied for achieving a desired blade angle.

* * * * *

UNITED STATES PATENT OFFICE

CERTIFICATE OF CORRECTION

Patent No. 4,369,590 Dated January 25, 1983

Inventor(s) Michael E. Miller

It is certified that error appears in the above-identified patent and that said Letters Patent are hereby corrected as shown below:

Col. 6, Claim 1, line 38, delete "recesses" and insert ---members---;

Col. 7, Claim 1, line 10, after "attachment" insert ---means---;

Col. 7, Claim 1, line 11, after "frame" delete "means".

Signed and Sealed this

Twenty-second Day of March 1983

[SEAL]

*Attest:*

GERALD J. MOSSINGHOFF

*Attesting Officer* *Commissioner of Patents and Trademarks*